US006571840B1

(12) United States Patent
Atkins et al.

(10) Patent No.: US 6,571,840 B1
(45) Date of Patent: Jun. 3, 2003

(54) COMPOSITE FURNITURE ORNAMENTATION

(75) Inventors: Timothy J. Atkins, Hickory, NC (US); John T. Sexton, Claremont, NC (US)

(73) Assignee: The Lane Co., Inc., Altavista, VA (US)

( * ) Notice: Subject to any disclaimer, the term of this patent is extended or adjusted under 35 U.S.C. 154(b) by 78 days.

(21) Appl. No.: 09/661,339

(22) Filed: Sep. 14, 2000

(51) Int. Cl.[7] ..... B27H 1/00

(52) U.S. Cl. ..... 144/358; 8/471; 101/127.1; 144/3.1; 144/329; 144/364; 144/357; 144/382; 156/230; 156/62; 427/152; 451/31; 409/80; 409/165

(58) Field of Search ..... 8/471; 52/377.1; 29/527.2; 101/127.1, 126, 129, 401; 144/2.1, 3.1, 358, 329, 361, 330, 363, 364, 371, 356; 409/79, 80, 165; 156/230, 234, 235, 62

(56) References Cited

U.S. PATENT DOCUMENTS

| | | | | | |
|---|---|---|---|---|---|
| 4,113,099 | A | | 9/1978 | Beckerman | 206/575 |
| 5,435,770 | A | | 7/1995 | Balentine | 451/31 |
| 5,484,495 | A | * | 1/1996 | Moore | 156/62 |
| 5,543,103 | A | * | 8/1996 | Hogan et al. | 409/80 X |
| 5,831,641 | A | * | 11/1998 | Carlson | 409/165 X |
| 6,221,188 | B1 | * | 4/2001 | Chubb et al. | 156/63 |
| 6,277,229 | B1 | * | 8/2001 | Popat et al. | 156/230 |
| 6,296,900 | B1 | * | 10/2001 | Barnhart et al. | 101/490 X |

* cited by examiner

*Primary Examiner*—W. Donald Bray
(74) *Attorney, Agent, or Firm*—MacCord Mason PLLC

(57) ABSTRACT

A furniture surface includes a new solid wood substrate, a two-color silk screened image on the substrate, and a CNC-carved and embossed indentation in the substrate that provides a relief effect located in reference to the printed image so as to make a composite ornamentation on the substrate that makes the substrate look antique.

18 Claims, 3 Drawing Sheets

COMPOSITE FURNITURE ORNAMENTATION

BACKGROUND OF THE INVENTION

The present invention relates to improvements in the manufacture of panels to add ornamentation and is particularly applicable to furniture panels. The panels may be used for cabinets, armoires, tables, chests, and various other items on which it is desired to display a decorated surface.

Throughout the history of furniture making, a variety of ornamentation techniques have been adopted, including the application of finishes, carving, printings, decals, and the like, to provide surface ornamentation on the panel. In recent decades, it has been desirable, in some cases, to provide a distressed appearance on items, which is achieved by various methods including whipping furniture items with chains or other techniques to intentionally indent and scour the surface. Such distressing techniques have been widely used and achieved commercial success. They have typically involved a certain amount of randomness in their application.

Carving is also known and has been used extensively, including carving using computer-numerically controlled (CNC) machines to achieve their results. Such CNC-carving has never previously been coupled with printing techniques, in a controlled fashion, to be able to reproduce on a mass-production basis, an antique look to furniture. As a result, the mass-production of furniture has, of this invention, not yielded a desired ornamented surface.

SUMMARY OF THE INVENTION

The present invention fulfills this need in the art by providing a furniture surface having a substrate, a printed image on the substrate, and a CNC-carved indentation in the substrate that provides a relief effect located in reference to the printed image so as to make a composite ornamentation on the substrate.

The substrate is preferably a solid wood substrate. However, engineered wood or plywood may be substituted.

The printed image is preferably a silk screened image. Particularly attractive effects may be obtained using a two-color image.

Typically, the substrate is new, and the composite ornamentation makes the substrate look antique.

In a preferred embodiment, the CNC-carved indentations are also embossed and are not sanded.

The invention also provides a method of ornamenting a furniture surface including, printing an image on a substrate, and automatically carving an indentation in the substrate that provides a relief effect located in reference to the printed image, so as to make a composite ornamentation on the substrate.

The printing may be silk screen printing, preferably printing at least two colors on the substrate.

The automatic carving is preferably CNC-carving and more preferably CNC-routing.

The automatic carving may include using an automatic carving machine to locate a reference point in the printed image and carving the indentation in the substrate at a location determined from the reference point, so that the relief effect location is coordinated to the printed image. The automatic carving may carve the indentations by movement of a cutter head in x, y, z and rotation directions determined in reference to the reference point in the printed image.

In a preferred embodiment, the indentation has a perimeter and the automatic carving carves the perimeter before a contour within the perimeter.

Preferably, the method includes a subsequent process of embossing the carved indentation. This may provide a texture to the indentation.

The method may also include applying finish and/or a decal to the printed, carved and embossed substrate.

BRIEF DESCRIPTION OF THE DRAWINGS

These and other features, aspects and advantages of the present invention will be better understood by those skilled in the art after a review of the following description, appended claims, and accompanying drawings where:

DETAILED DESCRIPTION OF THE PREFERRED EMBODIMENTS

Figure 1:
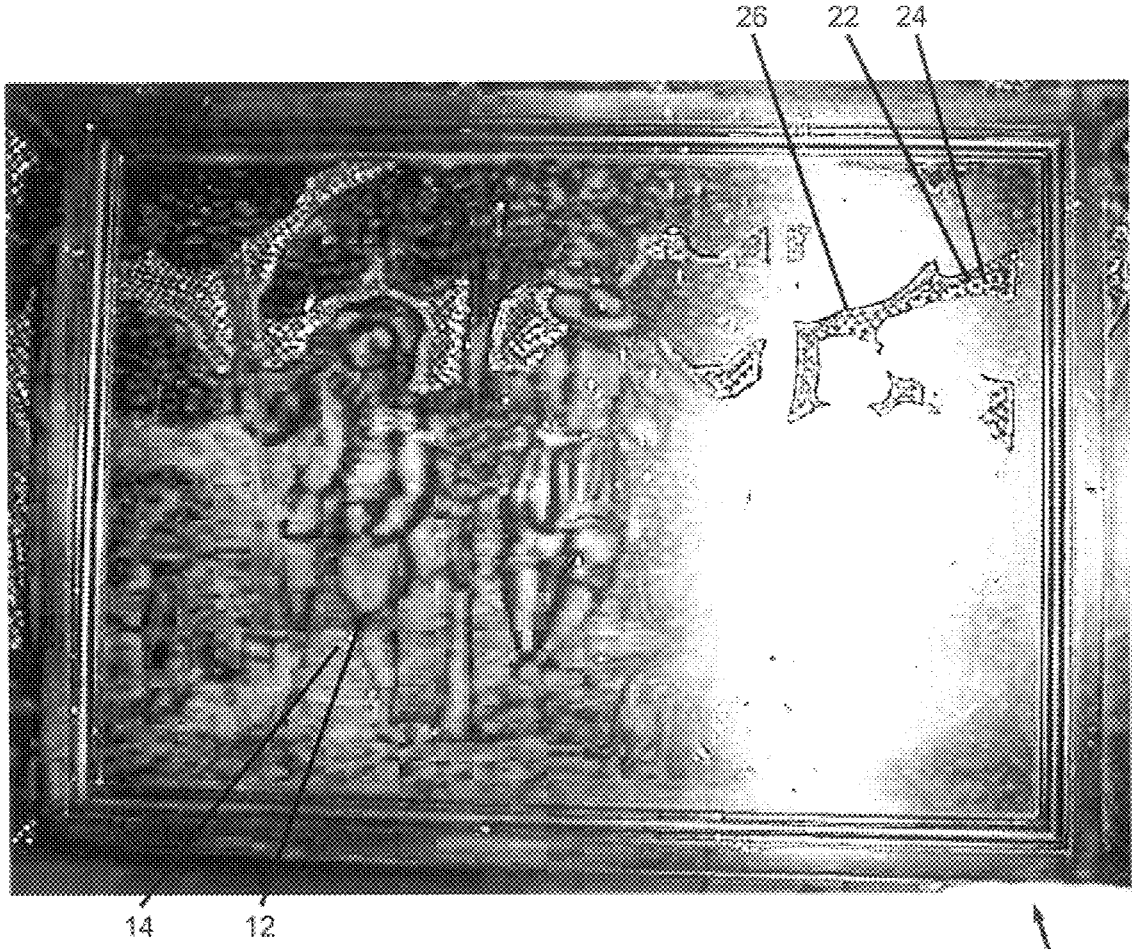
FIG. 1 is a digital photograph of a panel according to the invention.

As can be seen in FIG. 1, panel 10 is provided to have printing in two colors, such as black printing 12 and a brown printing 14. As depicted in FIG. 1, outlines of a human image can be seen printed in the black 12 with background visual elements showing up in the brown print 14. In the embodiment shown in FIG. 1, which is a digital photograph of a panel made according to the invention, the substrate is pre-colored with a dark red overall tone.

Figure 2:
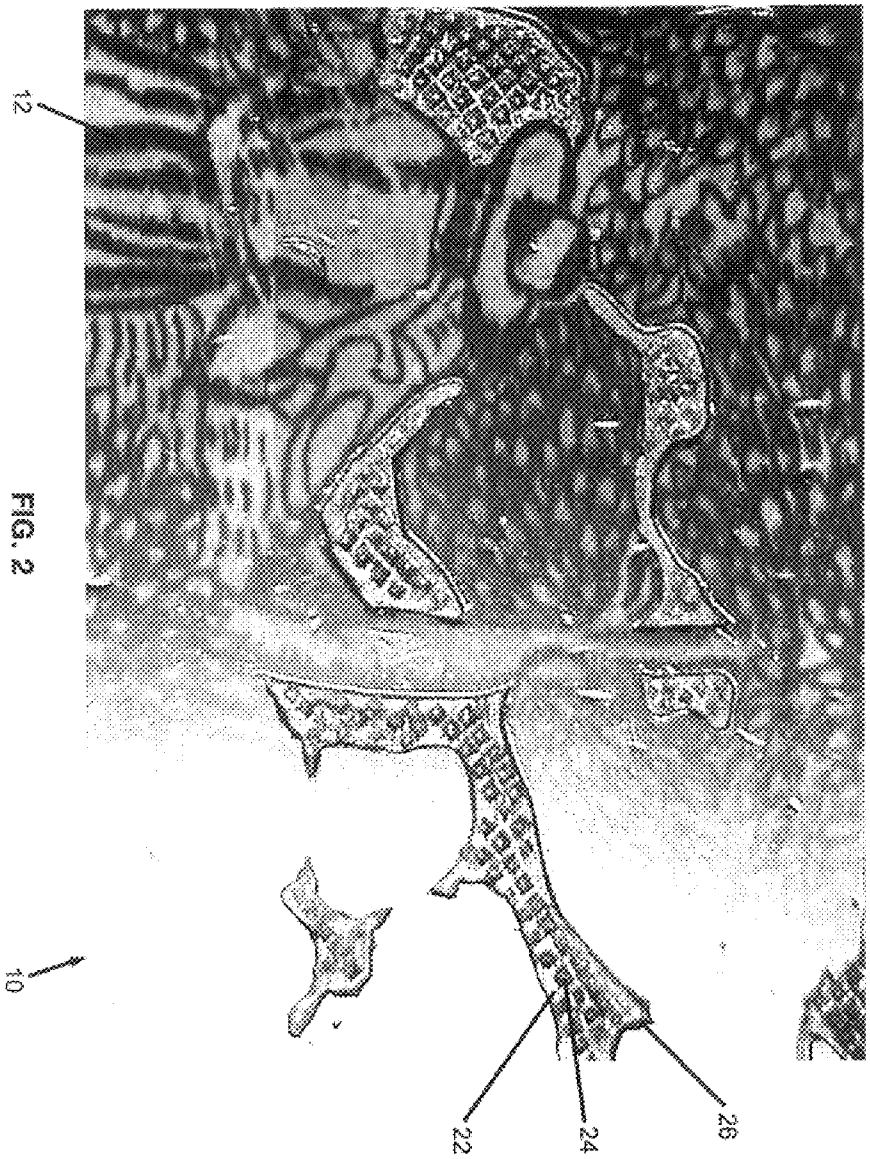
FIG. 2 is a digital photograph closeup of the panel of FIG. 1.
Figure 3:
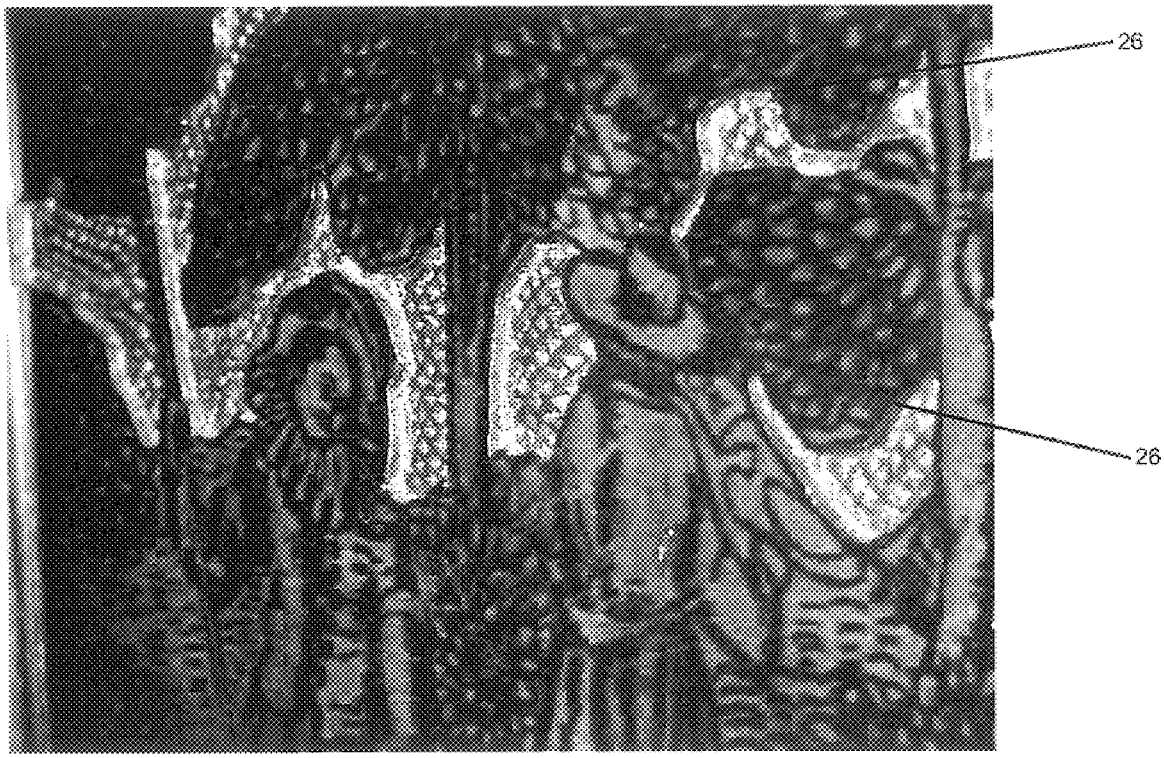
FIG. 3 is a digital photograph closeup of the panel of FIG. 1 taken from a different angle to show the relief effect.

The panel 10 is also provided with indentations 22 including diamond shaped embossments 24 within a perimeter relief effect 26. Additional printed images and indentations can also be seen in FIG. 1 and in the other figures, which are different views of the substrate depicted in FIG. 1. Thus, as seen in FIG. 2, which is an enlarged view of an image of FIG. 1, the black print 12 can clearly be seen, which, together with the indentation of 22, contribute to the overall ornamental effect. Within the indentations 22, the diamond pattern embossments 24 can be seen within the perimeter edges 26.

Images depicted in the Figures may be mass-produced by using techniques of the method according to the invention.

To produce the panel, first the desired image is prepared for application to a suitable substrate. Suitable substrates are typically solid wood, but other surfaces could be used, such as engineered wood or plywood. The printed image is applied by any technique suitable for mass-production. In a preferred embodiment the image is applied using silk screening. In this process a plurality of colors are applied to the surface preferably to achieve multiple colors, although single color prints are also included within the scope of the invention. Other methods of applying the color could include stenciling, application of decals, or any other suitable technique. In addition, such techniques can be applied after the carving described, hereinafter, if desired.

After the substrate has been printed with the desired print, the substrate is treated as a template, and areas in which carving is desired are hand carved, to provide indentations in the desired areas. Then, the hand carved and printed substrate is subjected to a scanning operation in which the locations of the carved areas are detected and recorded, such as in a CNC-carving or routing machine or other electronic memory. For the purposes of this invention CNC-routing is deemed to be a species of the genus of CNC-carving. In the process of scanning, a particular point in the printed image on the substrate is selected as a reference point, so that the CNC data is in registration with the printed image when the CNC data is later used to carve other printed substrates. Alternatively, if registration of the print on the substrate area is carefully controlled, then the CNC-router can be keyed to a corner or other benchmark on the substrate itself, without reference to the printed image, to achieve registration. However, in a preferred environment, the CNC-router is keyed to a point on the printed image as a reference. The derived data is stored for later use.

The prototype or template substrate then is subjected to a hand embossing step, resulting in the diamond shape embossments like those shown by reference number 26. Other embossment patterns can, of course, be used, to provide a texture to the carved indentations. The printed, carved, and embossed template substrate is then used to make a conforming embossment tool for the substrate. This embossment tool is a surface having raised portions corresponding to the recesses of the indentations, such as the diamond shaped pits 26. That is, raised portions on the tool complement the recesses in the template substrate. This embossment tool is then saved for later use in an embossing press.

At this stage, mass-production of the surfaces may ensue. In order to do so, the surfaces are prepared as desired. They are subsequently printed with the printed pattern such as the silk-screen pattern or other design as desired. The printed substrate is then subjected to CNC-routing or carving. In this step, the CNC-carving machine finds the reference point in the print or elsewhere on the printed substrate and controls a carver or router head to form the indentations in the substrate in registration with the previously printed image. In doing so, the stored data is used to control the cutter head in x, y, z and rotational direction, according to known CNC-carver technology. Once the CNC-carving is complete, the panel may be taken to an embossing machine equipped with the previously made embossment tool, which then embosses the freshly carved substrate. In so doing, the diamond pattern or other selected embossment pattern is impressed into the indentation. This has a result of compressing the wood fibers and causing a smoothing affect, so that sanding of the embossed indentations is not required.

If desired, a final coat of finish can be applied to protect this printed, carved, and embossed substrate.

During the carving, the automatic carving machine typically carves the perimeter of the indentation before any contours with in the perimeter of the indentation.

In reducing the invention to practice, it has been found useful to use a Kitako brand CNC-routing machine, model number CDH-1276-U. A Fanuc Series 15M machine may also be suitable, along with machines from other vendors.

If desired, the ornamentation provided by the present invention could be applied to various surfaces such as kitchen cabinets, panels (to be hung as art work by themselves) and interior trim surfaces, such as doors, or the like.

Although the present invention has been described in considerable detail with respect to a certain preferred versions thereof, other versions are possible. In particular, the invention can be used to achieve a wide variety of panel appearances beyond those depicted in the drawings. Therefore, the spirit and scope of the appended claims should not be limited to the description of the preferred versions herein.

All patents and other documents identified in the present application are hereby incorporated by reference.

What is claimed is:

1. A method of ornamenting a furniture surface comprising printing an image on a substrate, and automatically carving an indentation in the substrate that provides a relief effect located in reference to the printed image so as to make a composite ornamentation on the substrate.

2. A method as claimed in claim 1 wherein the substrate is new and the composite ornamentation makes the substrate look antique.

3. A method as claimed in claim 1 wherein printing includes silk screen printing.

4. A method as claimed in claim 3 wherein the silk screen printing prints at least two colors on the substrate.

5. A method as claimed in claim 1 wherein the automatic carving is CNC-carving.

6. A method as claimed in claim 1 wherein the automatic carving is CNC-routing.

7. A method as claimed in claim 1 wherein the automatic carving includes using an automatic carving machine to locate a reference point in the printed image and carving the indentation in the substrate at a location determined from the reference point so that the relief effect is located in reference to the printed image.

8. A method as claimed in claim 1 wherein the automatic carving proceeds to carve the indentations by movement of a cutter head in x, y, z and rotation directions determined in reference to the reference point in the printed image.

9. A method as claimed in claim 1 wherein the indentation has a perimeter and the automatic carving carves the perimeter before a contour within the perimeter.

10. A method as claimed in claim 1 further comprising embossing the carved indentation.

11. A method as claimed in claim 1 further comprising embossing the carved indentation to provide a texture to the indentation.

12. A method as claimed in claim 11 further comprising applying finish to the printed, carved and embossed substrate such that the textured indentation absorbs finish.

13. A method as claimed in claim 1 further comprising applying finish to the printed and carved substrate.

14. A method of ornamenting a furniture surface comprising:

silk screen printing an image having at least two colors on a new substrate,

CNC-routing indentations in the substrate to provide a relief effect located in reference to the printed image by locating a reference point in the printed image with a CNC-router and routing the indentations by movement of a router head in x, y, z and rotation directions determined in reference to the reference point in the printed image wherein the indentation has a perimeter and the automatic carving carves the perimeter before a contour within the perimeter, so that the relief effect is located in reference to the printed image, embossing the routed indentations to provide texture to the indentations, and applying finish to the printed, routed and embossed substrate such that the textured indentations absorb finish, so as to make a composite ornamentation on the substrate that makes the substrate look antique.

15. A method for making a furniture surface having a composite surface ornamentation comprising:

providing a substrate;

printing an image on the substrate; and keying a tool to at least a portion of the printed image and carving the substrate with the keyed tool to make an indentation effect in the substrate that registers with the printed image.

16. The method of claim 15, wherein carving the substrate further comprises embossing indentations in the substrate.

17. A method of mass-producing ornamentation on substrates comprising applying a printed image to a template surface and carving indentation in the template surface at locations selected in reference to the printed image, scanning the template surface with an electronic device and recording signals representing carved locations of the template surface in reference to a visually discemable point on the printed template surface, printing additional surfaces with the same image as printed on the template surface, and, using the recorded signals to control a CNC-Carver to carve the additional printed surfaces.

18. A method as claimed in claim 17 further comprising hand embossing the carved locations of the template surface, making an embossing tool to conform to the embossed carved template surface and embossing the additional surfaces with the embossing tool after they have been printed and carved.

* * * * *